US006534737B1

(12) United States Patent
Rademacher et al.

(10) Patent No.: US 6,534,737 B1
(45) Date of Patent: Mar. 18, 2003

(54) CONTACT CLOSING SPEED LIMITER FOR A TRANSFER SWITCH

(75) Inventors: Loren L. Rademacher, Andover, MN (US); John E. Morley, Stacy, MN (US); Constantine Xykis, Eagan, MN (US)

(73) Assignee: Onan Corporation, Minneapolis, MN (US)

( * ) Notice: Subject to any disclaimer, the term of this patent is extended or adjusted under 35 U.S.C. 154(b) by 0 days.

(21) Appl. No.: 10/078,786

(22) Filed: Feb. 19, 2002

(51) Int. Cl.[7] ..... H01H 23/00
(52) U.S. Cl. ..... 200/401; 200/1 V
(58) Field of Search ..... 200/1 V, 401, 200/33 R, 34, 416, 428, 50.32, 50.33, 1 R, 573, 574; 218/154

(56) References Cited

U.S. PATENT DOCUMENTS

| | | | | |
|---|---|---|---|---|
| 3,715,545 A | | 2/1973 | Long | 200/159 A |
| 3,719,788 A | | 3/1973 | Holland et al. | 200/153 LB |
| 4,472,701 A | | 9/1984 | Bellows et al. | 335/23 |
| 4,488,133 A | | 12/1984 | McClellan et al. | 335/16 |
| 4,539,538 A | | 9/1985 | Flick et al. | 335/16 |
| 4,642,431 A | | 2/1987 | Tedesco et al. | 200/153 |
| 4,645,890 A | | 2/1987 | Paton et al. | 200/153 G |
| 4,791,393 A | | 12/1988 | Flick et al. | 335/16 |
| 4,855,543 A | | 8/1989 | Speer et al. | 200/61.27 |
| 4,861,948 A | | 8/1989 | Fogleman, Sr. | 200/5 B |
| 4,874,911 A | | 10/1989 | Parrish | 200/6 R |
| 5,504,290 A | * | 4/1996 | Baginski et al. | 200/401 |
| 5,793,270 A | | 8/1998 | Beck et al. | 335/16 |
| 5,927,485 A | | 7/1999 | Linek et al. | 200/551 |

* cited by examiner

*Primary Examiner*—Michael Friedhofer
*Assistant Examiner*—Lisa N Klaus
(74) *Attorney, Agent, or Firm*—Schwegman, Lundberg, Woessner & Kluth, P.A.

(57) ABSTRACT

A transfer switch that absorbs the kinetic energy of a toggle mechanism within the transfer switch just before moving contacts on the toggle mechanism engage a set of stationary contacts. The transfer switch includes output contacts, primary input contacts, secondary input contacts and a toggle mechanism. The toggle mechanism includes moving contacts that alternately connect the output contacts with the primary and secondary input contacts. The transfer switch further includes a dampener that reduces the kinetic energy of the moving contacts before the moving contacts engage the input contacts.

18 Claims, 7 Drawing Sheets

CONTACT CLOSING SPEED LIMITER FOR A TRANSFER SWITCH

FIELD OF THE INVENTION

The present invention relates to a transfer switch, and in particular to a transfer switch that limits contact closing speed.

BACKGROUND

A transfer switch is used to switch an electric load back and forth between a primary source, such as a utility, and a secondary source, such as a generator. Transferring power from the primary source to the secondary source is necessary when the incoming power quality deviates from set limits. The transfer switch is also used to switch the source back to utility power when the power quality returns to within the preset limit.

Some transfer switches have more control than others as they change power sources. Many transfer switches are able to disconnect the load from both sources for a desired period of time in order to allow residual electricity to discharge before the load is switched to an alternate power source.

A typical transfer switch includes a reciprocating toggle mechanism. The toggle mechanism includes contacts that move along with the toggle mechanism relative to stationary contacts on the transfer switch. The movable contacts engage one set of stationary contacts when power is supplied by the primary source and engage another set of contacts when power is supplied from the secondary source.

The toggle mechanism often includes a rotating crossbar such that the moving contacts are mounted on the crossbar. The crossbar is connected to springs that store energy within an actuation mechanism. The actuating mechanism is activated either manually or automatically at a desired time to release the stored energy and move the crossbar. The crossbar moves very fast such that the crossbar and contacts have a significant amount of kinetic energy as the moving contacts engage either set of stationary contacts. The toggle mechanisms and contacts in transfer switches with high short-circuit withstand capability are usually more massive such that these types of toggle mechanisms have even greater kinetic energy.

As the moving contacts engage the stationary contacts, the kinetic energy of the moving contacts causes the contacts on the crossbar to bounce up and down on the stationary contacts until the kinetic energy is dissipated. Contact bounce can cause arcing that damages the contacts. When there is contact arcing at high current, the contacts can be severely eroded or even completely vaporized.

The high speed of the moving contacts can also cause the contacts to crack as they impact the stationary contacts, especially when the contacts within the transfer switch are massive. The sudden deceleration of the toggle mechanism can also cause components with the toggle mechanism to bend or break.

SUMMARY OF THE INVENTION

The present invention relates to a transfer switch that absorbs the kinetic energy of a toggle mechanism within the transfer switch just before moving contacts on the toggle mechanism engage a set of stationary contacts. The moving contacts travel at high speed as they move toward the stationary contacts, and just before the moving contacts engage the stationary contacts an energy absorbing device removes the kinetic energy from the toggle mechanism. Reducing the kinetic energy of the moving contacts prior to engaging the stationary contacts minimizes contact bounce, especially when the transfer switch includes massive contacts, such as those used in transfer switches having high short-circuit withstand and closing capability.

The transfer switch includes output contacts, primary input contacts, secondary input contacts and a toggle mechanism. The toggle mechanism includes moving contacts that alternately connect the output contacts with the primary and secondary input contacts. The transfer switch further includes a dampener that is connected to the toggle mechanism. The dampener reduces the kinetic energy of the moving contacts before the moving contacts engage the input contacts.

The present invention also relates a method of alternating the supply of power to an electric load. The method includes switching contacts within a transfer switch to alternately engage the switching contacts with input contacts that are connected to a primary power source and input contacts that connected to a secondary power source. The method further includes reducing the kinetic energy of the switching contacts before the switching contacts engage the input contacts.

DETAILED DESCRIPTION

In the following detailed description, reference is made to the accompanying drawings which show by way of illustration specific embodiments in which the invention may be practiced. These embodiments are described in sufficient detail to enable those skilled in the art to practice the invention, and it is to be understood that other embodiments may be utilized and structural changes made without departing from the scope of the present invention. Therefore, the following detailed description is not to be taken in a limiting sense, and the scope of the present invention is defined by the appended claims and their equivalents.

Figure 1:
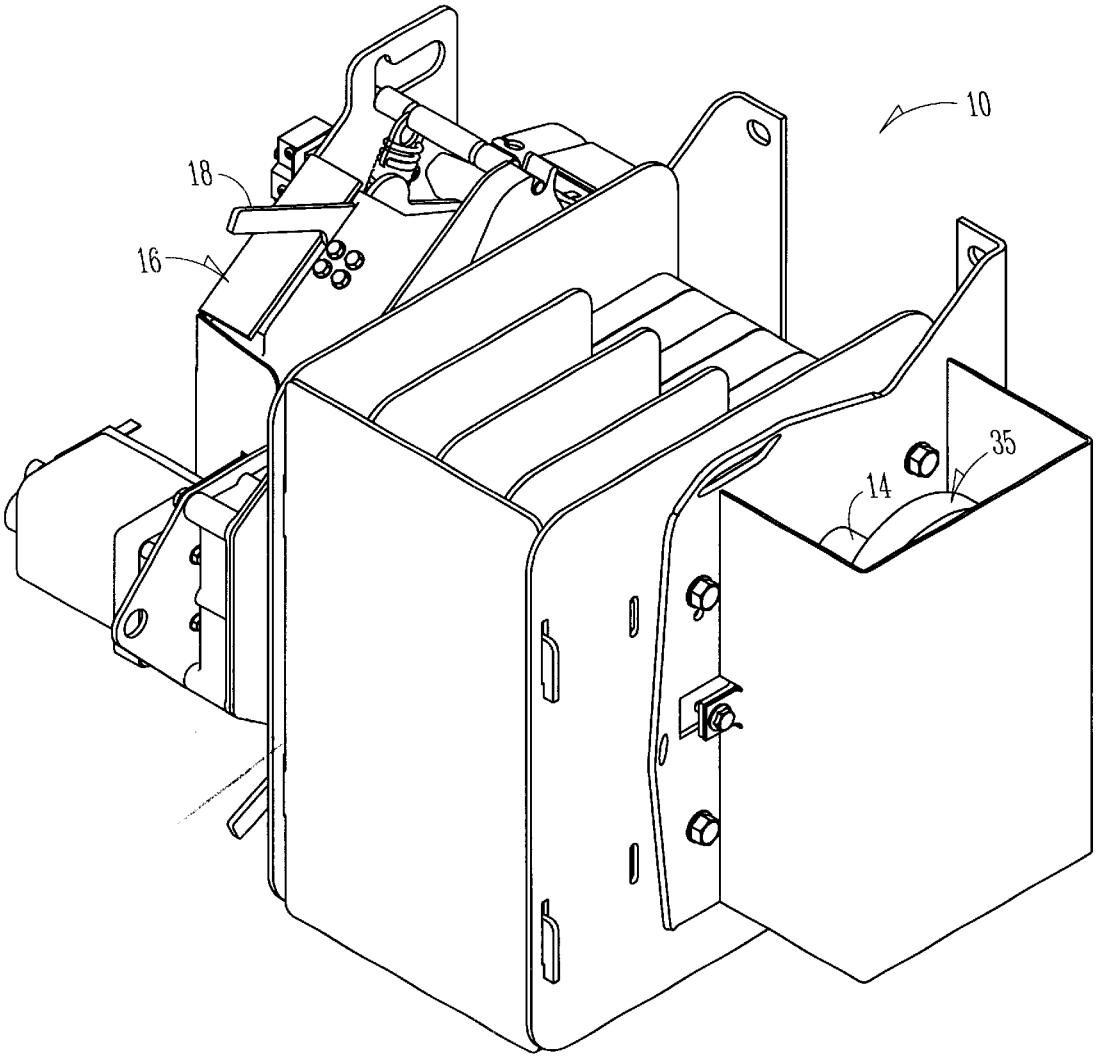
FIG. 1 is a perspective view illustrating a transfer switch of the present invention.
Figure 2:
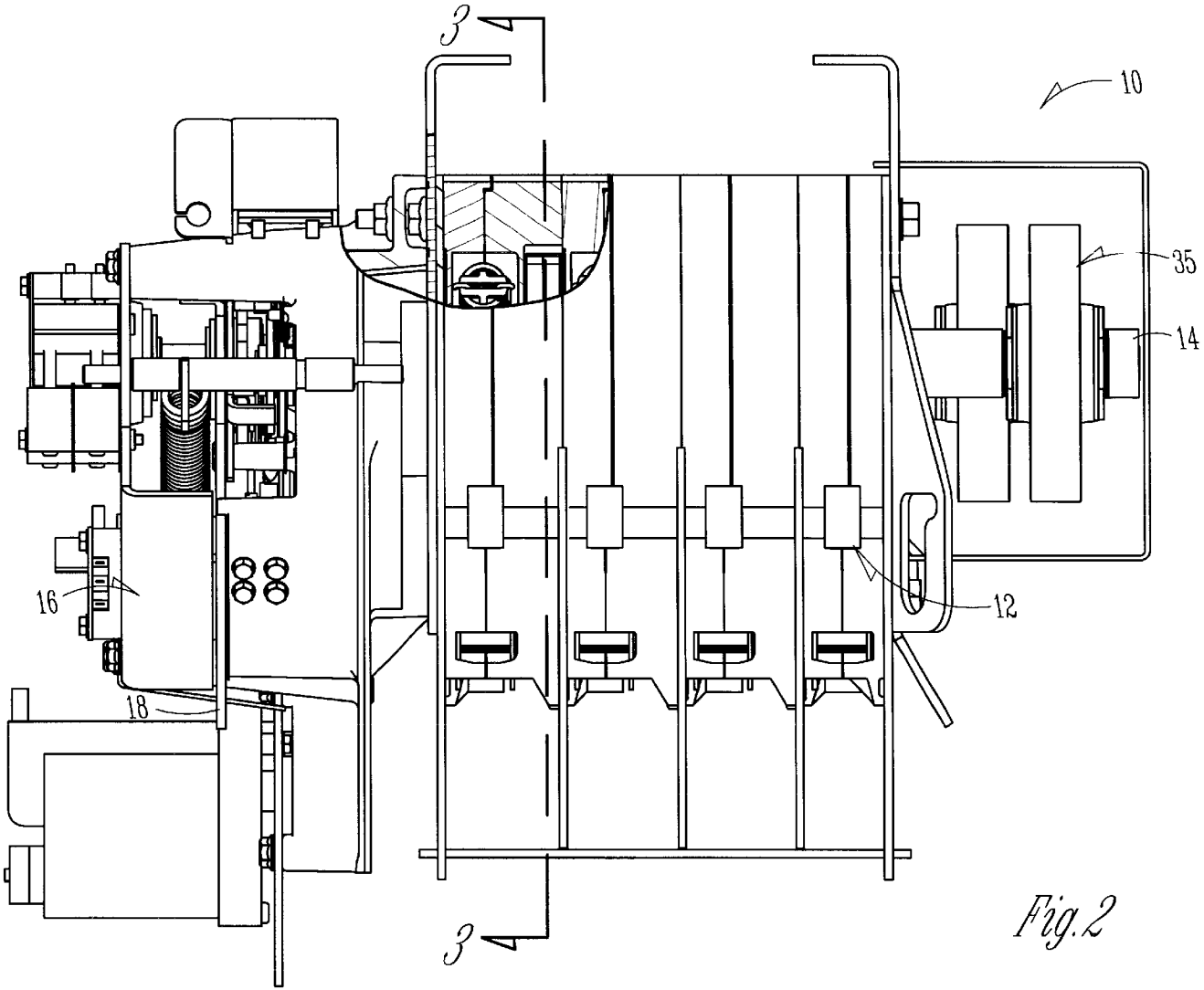
FIG. 2 is a top view of the transfer switch shown in FIG. 1.

FIGS. 1 and 2 show an embodiment of an electric transfer switch 10 that encompasses the present invention. The transfer switch 10 includes a toggle mechanism 12 (FIG. 2). The toggle mechanism 12 includes a pair of crossbars 14, 15 (see FIGS. 3 and 4) that extend through the transfer switch 10. The toggle mechanism 12 is connected to an actuating mechanism 16 that rotates the crossbars 14, 15 about their respective longitudinal axes. It should be noted that the actuating mechanism 16 can be operated manually using handle 18, or automatically using other types of devices.

A plurality of moveable contacts 20 are carried by each crossbar 14, 15. Each moveable contact 20 is connected to an output contact 21 and adapted to be intermittently connected to either a primary input contact 22 or a secondary input contact 23 depending on which crossbar 14, 15 the movable contacts 20 are mounted on. Cams 29 are mounted on the crossbars 14, 15 to maneuver the movable contacts 20 into, and out of, engagement with the stationary input contacts 22,23.

Figure 3:
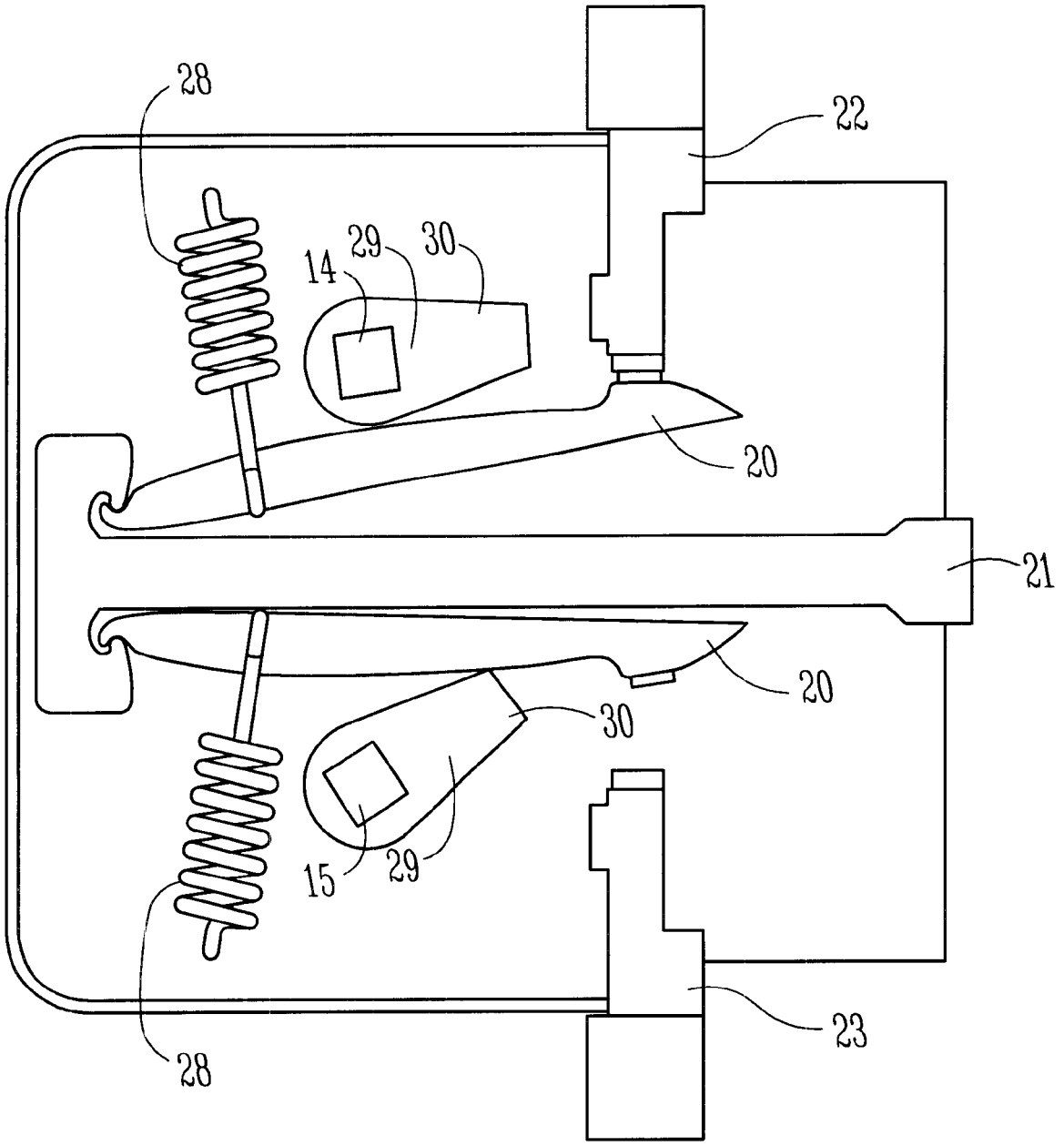
FIG. 3 is a schematic cross-sectional view of the transfer switch shown in FIG. 2 taken along line 3—3 with the transfer switch in position to supply power from a primary power source.
Figure 4:
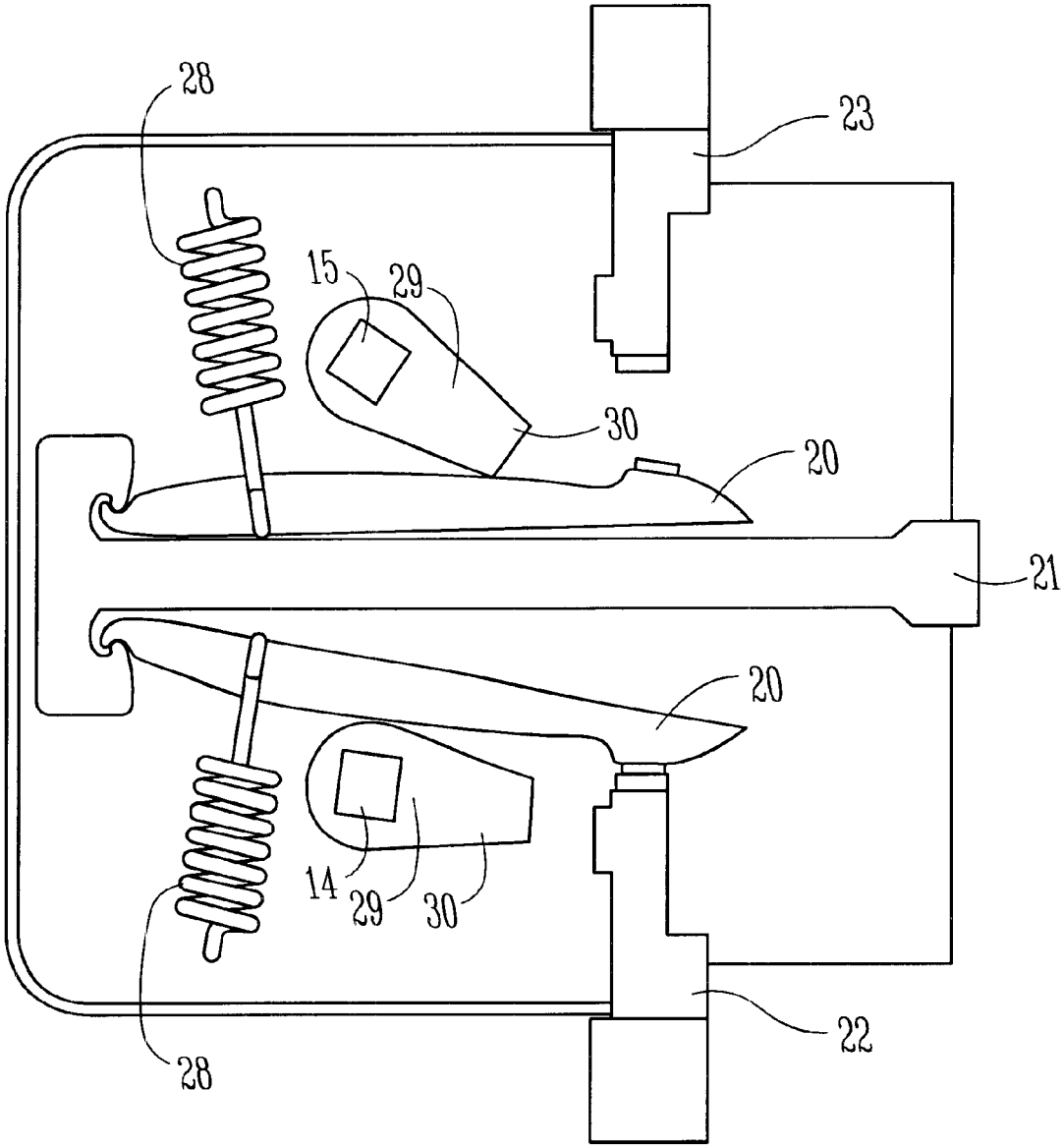
FIG. 4 is a schematic cross-sectional view similar to FIG. 3 with the transfer switch in position to supply power from a secondary power source.

FIG. 3 shows the movable contacts 20 engaged with the primary input contacts 22 when power is being from a primary power source, such as a utility. As shown in FIG. 4, when there is an interruption in the primary power supply, the cams 29 on crossbar 14 rotate to disengage the movable contacts 20 from the primary input contacts 22, and the cams 29 on crossbar 15 rotate to allow the movable contacts 20 to engage secondary input contacts 23 so that power can be supplied from a secondary power source, such as a generator. The transfer switch 10 may include the ability to control the amount of time it takes to switch from the normal main power supply to a standby emergency power supply.

A similar operation is performed to change the power supply back to the primary source from the secondary source. The cams 29 on crossbar 15 rotate to disengage the movable contacts 20 from the secondary input contacts 23 and the cams 29 on crossbar 14 rotate to allow the movable contacts 20 to engage the primary input contacts 22 so that power can once again be supplied from the primary source. It should be noted that in alternative embodiments, the transfer switch may include a single crossbar such that a single set of moving contacts reciprocates back and forth between the primary and secondary input contacts.

Springs 28 are disposed between each of the moveable contacts 20 and another portion of the transfer switch 10. The springs 28 apply a force to the movable contacts 20 that directs the each moveable contact 20 against a corresponding stationary input contact 22, 23. It should be noted that any type of spring can be used to bias the moveable contacts 20 into engagement with the stationary input contacts 22, 23.

The operation of the transfer switch 10 can be described as follows. The crossbars 14, 15 are rotated by the actuating mechanism 16 such that the cams 29 maneuver the movable contacts 20 relative to the stationary contacts 22, 23. As the cams 29 are rotated, the tips 30 on the cams 29 eventually begin to engage the movable contacts 20 and force the movable contacts 20 away from the stationary contacts 22, 23. Afterwards, once the tips 30 of the cams 29 rotate past the movable contacts 20, the springs 28 force the movable contacts 20 back into engagement with the stationary input contacts 22, 23. The combination of the cam 29 geometry and the force generated by the spring 28 causes the movable contacts 20 to move very fast toward the stationary input contacts 22, 23. Therefore, the movable contacts 20 have significant kinetic energy as they move toward the stationary input contacts 22, 23.

Each of the crossbars 14, 15 is connected to a damper 35. The dampers 35 are positioned at an end of the crossbars 14, 15 that is opposite to the actuating mechanism 16. In alternative embodiments of the invention, the dampers 35 are positioned at different points along the length of the crossbars 14, 15 (see e.g., FIG. 7).

Figure 5:
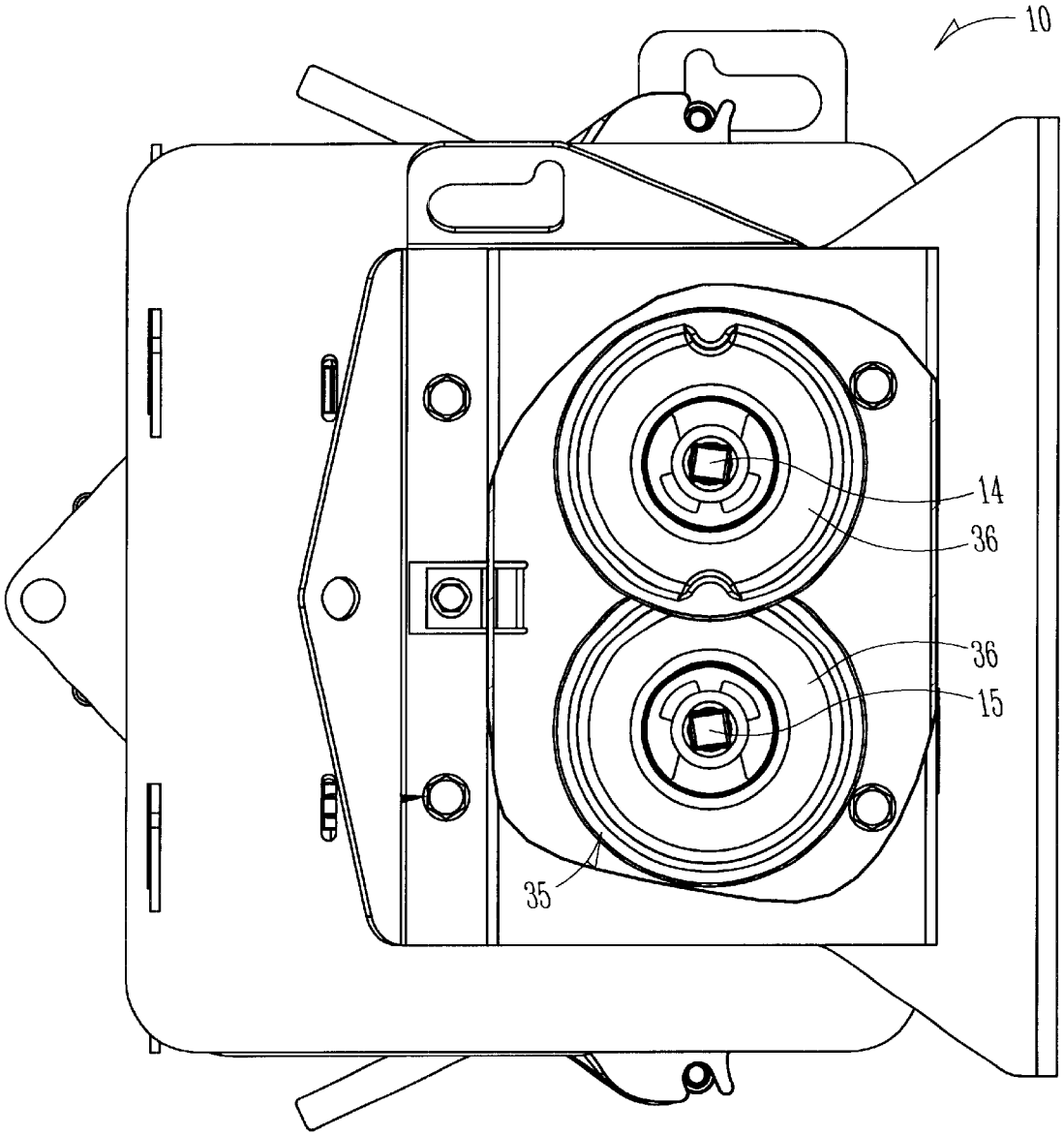
FIG. 5 is an end view of the transfer switch shown in FIG. 1.

FIG. 5 illustrates an example embodiment where each damper 35 is in the form of a flywheel and clutch combination 36 that reduces the kinetic energy of the movable contacts 20 before the movable contacts 20 engage the stationary input contacts 22, 23. Each flywheel and clutch combination 36 reduces the kinetic energy of the movable contacts 20 by inhibiting movement of the crossbars 14, 15. The flywheel and clutch combinations 36 preferably only inhibit motion of the crossbars 14, 15 as the movable contacts 20 are about to engage the stationary input contacts 22, 23, including permitting uninhibited movement of the crossbars 14, 15 as the movable contacts 20 are disengaged from stationary input contacts 22, 23.

Figure 6:
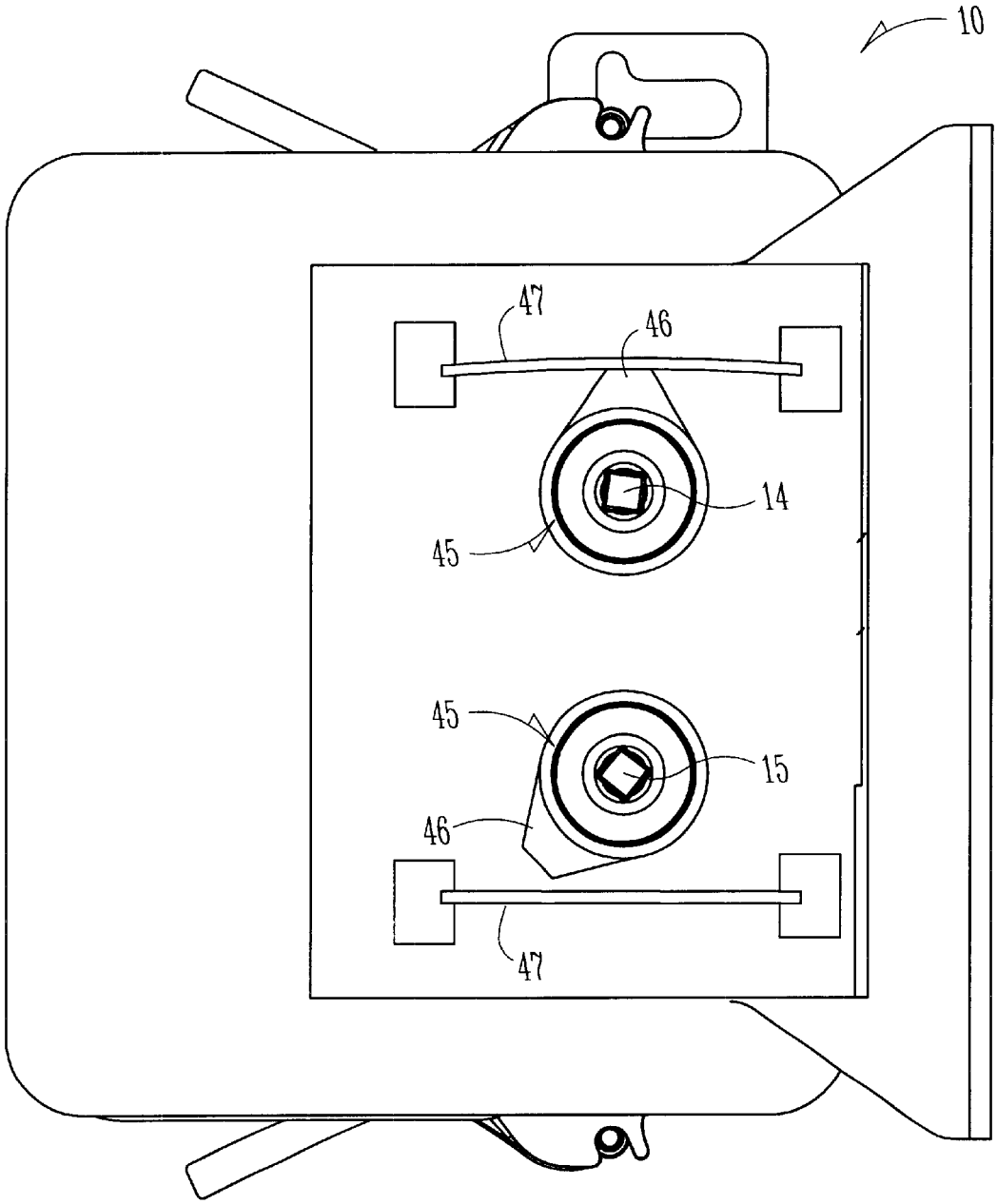
FIG. 6 is an end view similar to FIG. 5 illustrating another embodiment of the transfer switch.

FIG. 6 illustrates another type of damper 45 that may be used in the transfer switch 10. Each damper 45 includes a cam 46 that is mounted onto one of the respective crossbars 14, 15, and a leaf spring 47 that is adapted to be engaged by the cam 46. As the crossbars 14, 15 rotate, each of the cams 46 engages a leaf spring 47 at that point in the rotation of the crossbars 14, 15 where the movable contacts 20 are about to engage the stationary input contacts 22, 23. Engaging the cams 46 with the leaf springs 47 removes the kinetic energy from the crossbars 14, 15 before the movable contacts 20 engage the stationary input contacts 22, 23. The number and arrangement of the cams 46 and leaf springs 47 may be modified in alternative forms of the invention.

Each of the leaf springs 47 also preferably supplies a torque to the crossbars 14, 15 to help disengage the movable contacts 20 from the stationary input contacts 22, 23. The leaf springs 47 apply torque to the crossbars 14, 15 as the actuating mechanism 16 maneuvers the cams 46 on the crossbars 14, 15 out of engagement with leaf springs 47. The torque facilitates disengaging the movable contacts 20 from the stationary input contacts 22, 23 when power is transferred from one power source to another.

Figure 7:
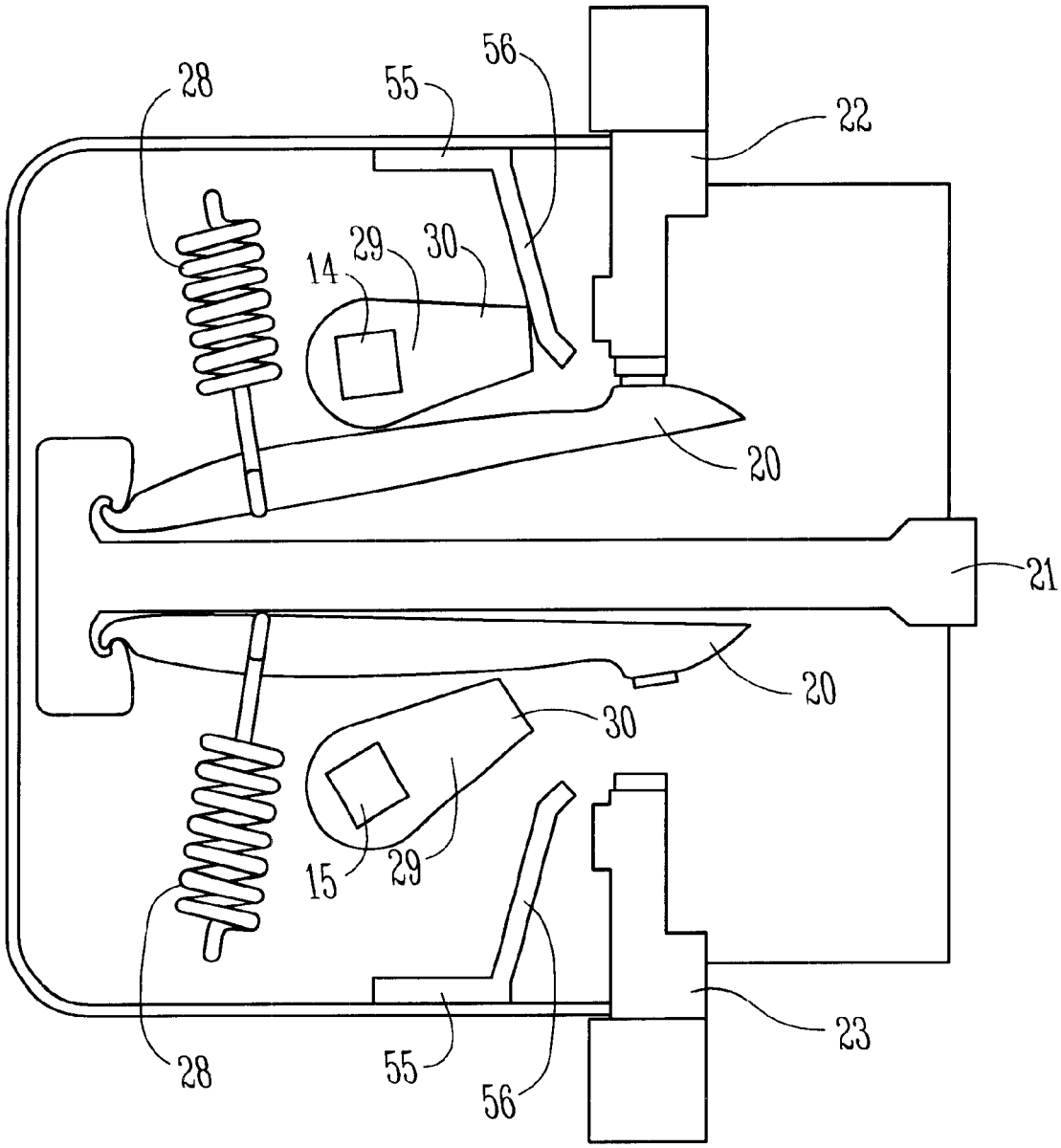
FIG. 7 is a schematic cross-sectional view similar to FIG. 3 illustrating an embodiment of a transfer switch that includes a dampener within the transfer switch.

FIG. 7 illustrates another example embodiment where a dampener 55 is positioned within the transfer switch 10. One or more dampers 55 are positioned adjacent to the cam 29 that are mounted onto the crossbars 14, 15. The dampener is in the form of a leaf spring 56 that is adapted to be engaged by the tips 30 of the cams 29. As the crossbars 14, 15 rotate, the tips 30 of each of the cams 29 engages a leaf spring 56 at that point in the rotation of the crossbars 14, 15 where the movable contacts 20 are about to engage the stationary input contacts 22, 23. Engaging the cams 29 with the leaf springs 56 removes the kinetic energy from the crossbars 14, 15 before the movable contacts 20 engage the stationary input contacts 22, 23.

The present invention also relates a method of alternating the supply of power to an electric load. The method includes switching contacts 20 within a transfer switch 10 to alternately engage the switching contacts 20 with input contacts 22 that are connected to a primary power source and input contacts 23 that are connected to a secondary power source. The method further includes reducing the kinetic energy of the switching contacts 20 before the switching contacts 20 engage the input contacts 22, 23.

Switching contacts 20 within the transfer switch 10 may also include maneuvering one or more crossbars 14, 15 that include the switching contacts 20 such that reducing the kinetic energy of the switching contacts 20 includes dampening the kinetic energy of the crossbars 14, 15 before the switching contacts 20 engage the input contacts 22, 23. It should be noted that switching contacts 20 within the transfer switch 10 may also include maneuvering a first crossbar 14 that is coupled to a first set of moving contacts 20 into and out of engagement with primary input contacts 22, and maneuvering a second crossbar 15 that is coupled to a second set of moving contacts 20 into and out of engagement with secondary input contacts 23.

Dampening the kinetic energy of the crossbars 14, 15 may also include attaching a clutch and flywheel combination 36 to each crossbar 14, 15 in order to reduce the kinetic energy of each crossbar 14, 15 before the switching contacts 20 engage the input contacts 22, 23. In an alternative embodiment, dampening the kinetic energy of the crossbars 14, 15 includes attaching a cam 46 to each crossbar 14, 15 and engaging the cams 46 with a respective leaf spring 47 to reduce the kinetic energy of the crossbars 14, 15 before the switching contacts 20 engage the input contacts 22, 23.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A transfer switch comprising:

output contacts;

primary input contacts;

secondary input contacts;

a toggle mechanism including moving contacts that alternately connect the output contacts with the primary input contacts and the secondary input contacts; and a dampener connected to the toggle mechanism to reduce kinetic energy of the moving contacts before the moving contacts engage the input contacts.

2. The transfer switch of claim 1 wherein the toggle mechanism includes one set of moving of moving contacts that engage the primary input contacts and a second set of moving contacts that engage the secondary input contacts.

3. The transfer switch of claim 1 further comprising an actuating mechanism that is coupled to the toggle mechanism to maneuver the toggle mechanism back and forth such that the moving contacts alternately engage the primary input contacts and the secondary input contacts.

4. The transfer switch of claim 3 wherein the actuating mechanism is manually operated.

5. The transfer switch of claim 3 wherein the toggle mechanism includes springs that bias the moving contacts toward the input contacts.

6. The transfer switch of claim 1 wherein the toggle mechanism includes a crossbar, and the dampener includes a flywheel and clutch combination coupled to the crossbar.

7. The transfer switch of claim 6 wherein the flywheel and clutch combination reduce the kinetic energy of the moving contacts before the moving contacts engage the input contacts by inhibiting crossbar movement.

8. The transfer switch of claim 7 wherein the flywheel and clutch combination permit the moving contacts to move freely as the moving contacts disengage from the input contacts.

9. The transfer switch of claim 1 wherein the toggle mechanism includes a crossbar such that the moving contacts are engaged with the crossbar, and the dampener includes a cam and a leaf spring, the cam being mounted on the crossbar such that the cam engages the leaf spring to reduce the kinetic energy of the crossbar before the moving contacts engage the input contacts.

10. A method of alternating the supply of power to an electric load comprising:

switching contacts within a transfer switch to alternately engage the switching contacts with primary input contacts that are coupled to a primary power source and secondary input contacts that are coupled to a secondary power source; and reducing the kinetic energy of the switching contacts before the switching contacts engage the input contacts.

11. The method of claim 10 wherein switching contacts within the transfer switch includes maneuvering a crossbar that is coupled to the switching contacts.

12. The method of claim 11 wherein reducing the kinetic energy of the switching contacts includes dampening the kinetic energy of the crossbar before the switching contacts engage the input contacts.

13. The method of claim 12 wherein dampening the kinetic energy of the crossbar includes attaching a clutch and flywheel combination to the crossbar that reduces the kinetic energy of the crossbar before the switching contacts engage the input contacts.

14. The method of claim 12 wherein dampening the kinetic energy of the crossbar includes attaching a cam to the crossbar and engaging the cam with a leaf spring to reduce the kinetic energy of the crossbar before the switching contacts engage the input contacts.

15. The method of claim 10 wherein switching contacts within the transfer switch includes maneuvering a first crossbar that is coupled to a first set of moving contacts into and out of engagement with the primary input contacts, and maneuvering a second crossbar that is coupled to a second set of moving contacts into and out of engagement with the secondary input contacts.

16. A transfer switch comprising:

output contacts;

primary input contacts;

secondary input contacts;

a toggle mechanism including moving contacts that alternately connect the output contacts with the primary input contacts and the secondary input contacts; and means for reducing kinetic energy of the moving contacts before the moving contacts engage the input contacts.

17. The transfer switch of claim 16, further comprising an actuating mechanism that maneuvers the toggle mechanism back and forth to alternately connect the output contacts with the primary input contacts and the secondary input contacts.

18. The transfer switch of claim 16, wherein the means for reducing kinetic energy of the moving contacts includes a dampener connected to the toggle mechanism to reduce kinetic energy of the moving contacts before the moving contacts engage the input contacts.

* * * * *

UNITED STATES PATENT AND TRADEMARK OFFICE

CERTIFICATE OF CORRECTION

PATENT NO. : 6,534,737 B1
DATED : March 18, 2003
INVENTOR(S) : Rademacher et al.

It is certified that error appears in the above-identified patent and that said Letters Patent is hereby corrected as shown below:

Column 5,
Line 31, after "set" delete "of moving".

Signed and Sealed this

Eighth Day of July, 2003

JAMES E. ROGAN
*Director of the United States Patent and Trademark Office*